US011110578B2

(12) United States Patent
Li et al.

(10) Patent No.: US 11,110,578 B2
(45) Date of Patent: Sep. 7, 2021

(54) LOCKING DEVICE ON THE STRIKER OF DOUBLE-CYLINDER ELECTRIC NAIL GUN

(71) Applicant: Zhejiang Rongpen Air Tools Co., Ltd., Zhejiang (CN)

(72) Inventors: Xiaorong Li, Zhejiang (CN); Fazheng Yang, Zhejiang (CN)

(73) Assignee: Zhejiang Rongpeng Air Tools Co. Ltd., Zhejiang (CN)

( * ) Notice: Subject to any disclaimer, the term of this patent is extended or adjusted under 35 U.S.C. 154(b) by 206 days.

(21) Appl. No.: 16/396,789

(22) Filed: Apr. 29, 2019

(65) Prior Publication Data

US 2020/0238494 A1 Jul. 30, 2020

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC ..... B25C 1/047; B25C 1/06; B25C 1/04
See application file for complete search history.

(56) References Cited

U.S. PATENT DOCUMENTS

| | | | | |
|---|---|---|---|---|
| 8,011,547 | B2 * | 9/2011 | Leimbach | B25C 1/06 227/8 |
| 9,539,714 | B1 * | 1/2017 | Pedicini | B25C 1/04 |
| 2007/0045377 | A1 * | 3/2007 | Towfighi | B25C 1/06 227/130 |
| 2018/0001452 | A1 * | 1/2018 | Li | B25C 1/04 |
| 2018/0043518 | A1 * | 2/2018 | Fukinuki | B25C 1/06 |
| 2019/0283225 | A1 * | 9/2019 | Zhao | B25C 1/047 |

* cited by examiner

*Primary Examiner* — Andrew M Tecco
*Assistant Examiner* — Nicholas E Igbokwe

(57) ABSTRACT

A locking device on the striker of double-cylinder electric nail gun, including a gear box, a union joint, a mobile hole; the union joint is connected to a first cylinder; the right sidewall of the gear box is provided with a second cylinder connected to the inner space thereof, the second cylinder is located normally under the first cylinder; a matched first piston is located in the first cylinder, a matched second piston is located in the second cylinder; the first piston is connected to a striker; the front of the striker penetrates through the mobile hole to the outside, the front of striker exposed to the outside is provided with several notches; an eccentric shaft seat is located in the gear box, one side of the eccentric shaft seat is provided with an eccentric shaft.

3 Claims, 7 Drawing Sheets

LOCKING DEVICE ON THE STRIKER OF DOUBLE-CYLINDER ELECTRIC NAIL GUN

BACKGROUND OF INVENTION

1. Field of the Invention

The present invention relates generally to a locking device on the striker of double-cylinder electric nail gun.

2. Description of Related Art

Before the double-cylinder electric nail gun is used, the striker component is locked by the spacer. The air pressure in the cylinder increases continuously when in use, the worker can apply an external force to disengage the spacer from the striker component, the striker can be pushed out by the increased air pressure, and the striker strikes the nail out. However, this nailing method cannot implement automatic nailing, the worker has to open the spacer whenever the air pressure is sufficient, very inconvenient, the nailing efficiency is influenced seriously.

SUMMARY OF THE INVENTION

The technical problem to be solved by the present invention is to provide a locking device on the striker of double-cylinder electric nail gun, which can open the spacer automatically when the air pressure in the nail gun is sufficient, so as to implement automatic nailing.

In order to solve the above problems, the technical scheme of the present invention is described below:

Effects of the Present Invention

In comparison to the existing technology, when the air pressure in the second cylinder is compressed to a certain extent, the eccentric shaft pushes the push part of the first rocker, the spacer is opened by the rocker component eventually. At this point, the high pressure in the second cylinder is directly applied to the first piston in the first cylinder through the second vent hole, ventilating chamber and the first vent hole in turn. When the striker is free from the limitation of spacer, the first piston ejects the striker instantaneously under high pressure, so that the striker strikes the nail out. This nailing method can eject the striker automatically when the air pressure in the first cylinder increases to a certain extent, so as to implement automatic nailing, preventing the complex nailing process that the worker has to open the spacer after the air pressure reaches the required level, the nailing efficiency is increased to the maximum extent.

DETAILED DESCRIPTION OF THE INVENTION

Figure 1:
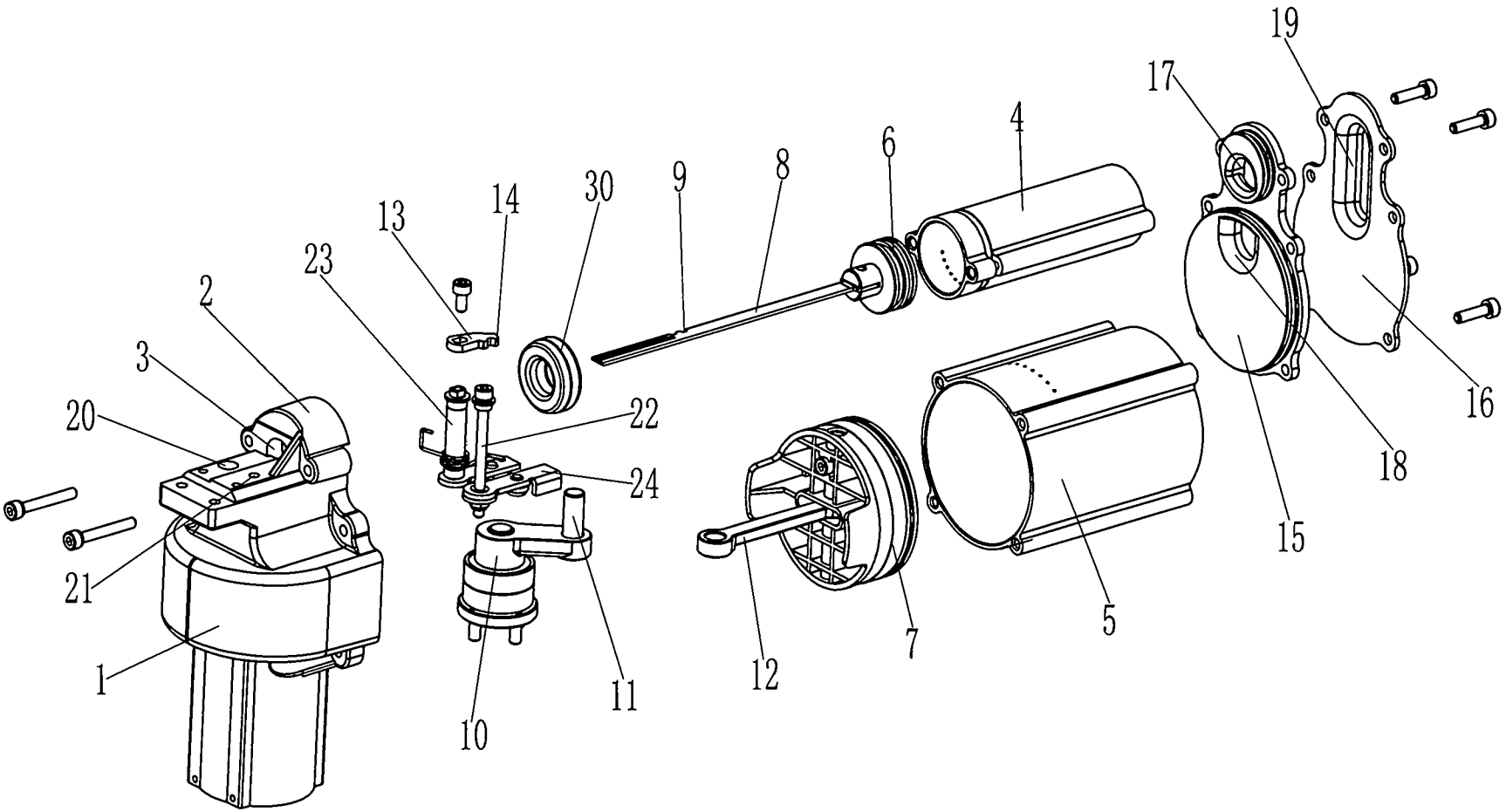
FIG. 1 is a structural representation of the locking device on the striker of double-cylinder electric nail gun of the present invention.
Figure 2:
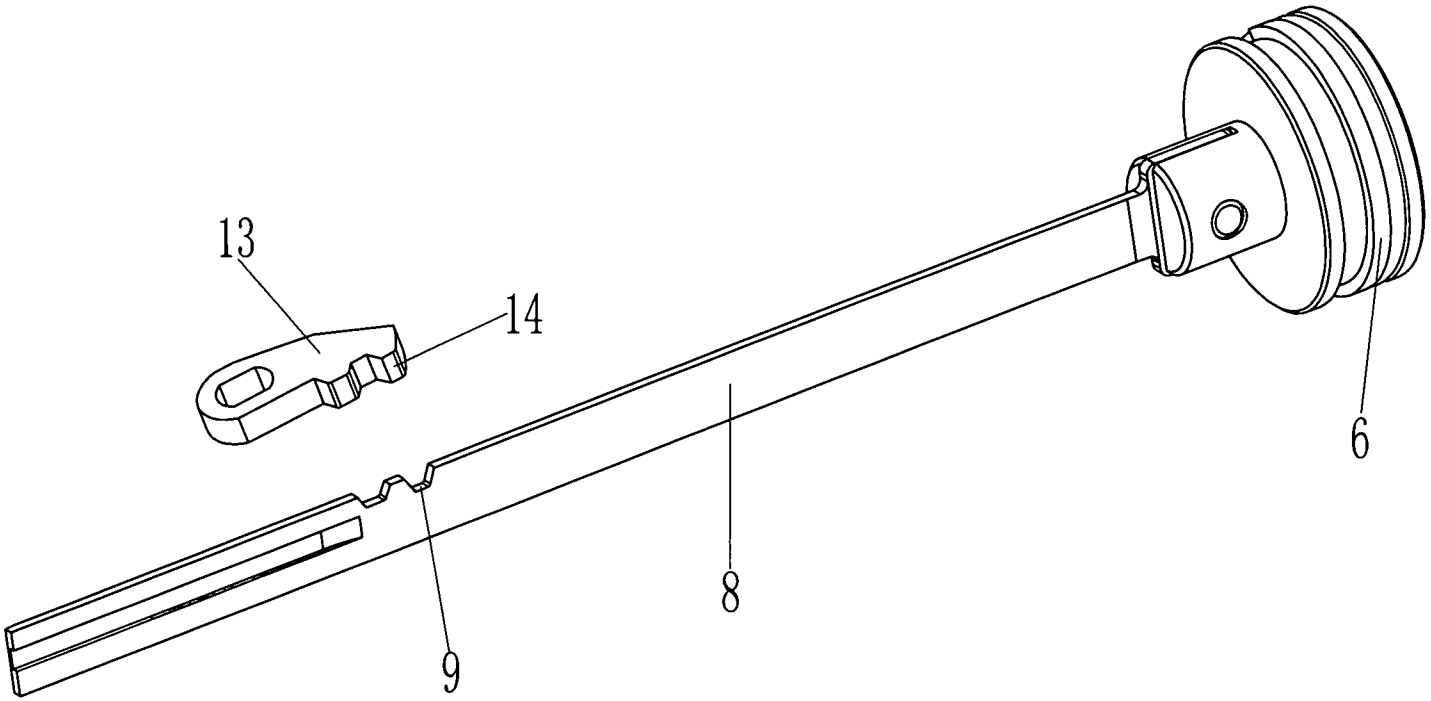
FIG. 2 is a structural representation of combination of striker and spacer.
Figure 3:
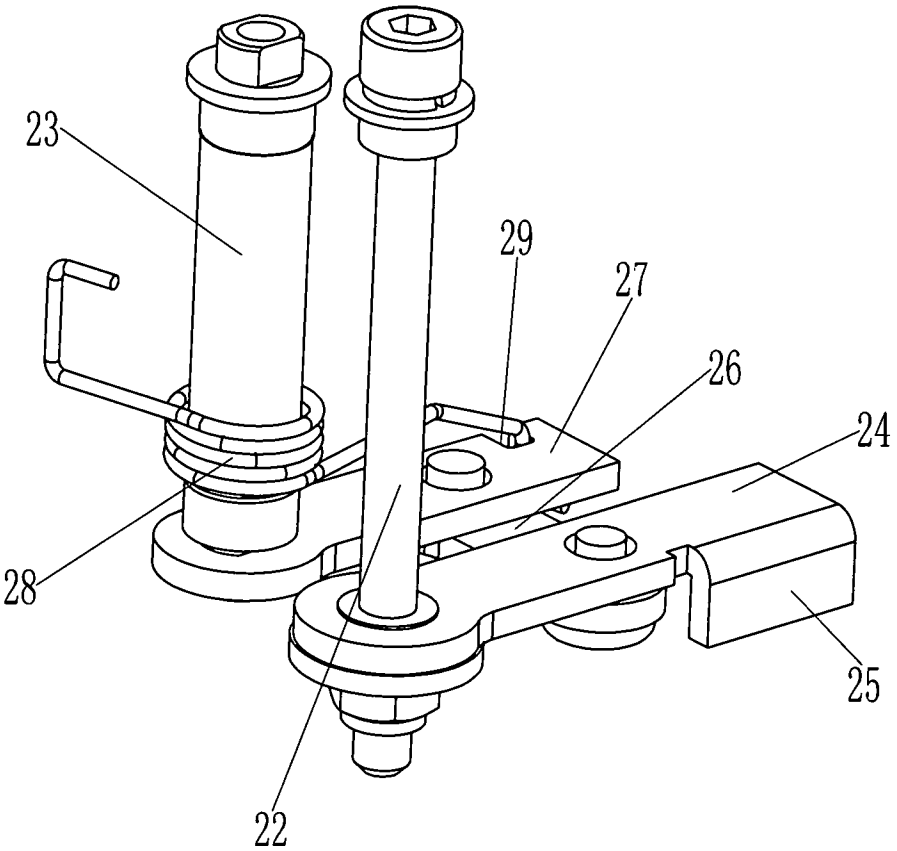
FIG. 3 is a structural representation of rocker component.
Figure 4:
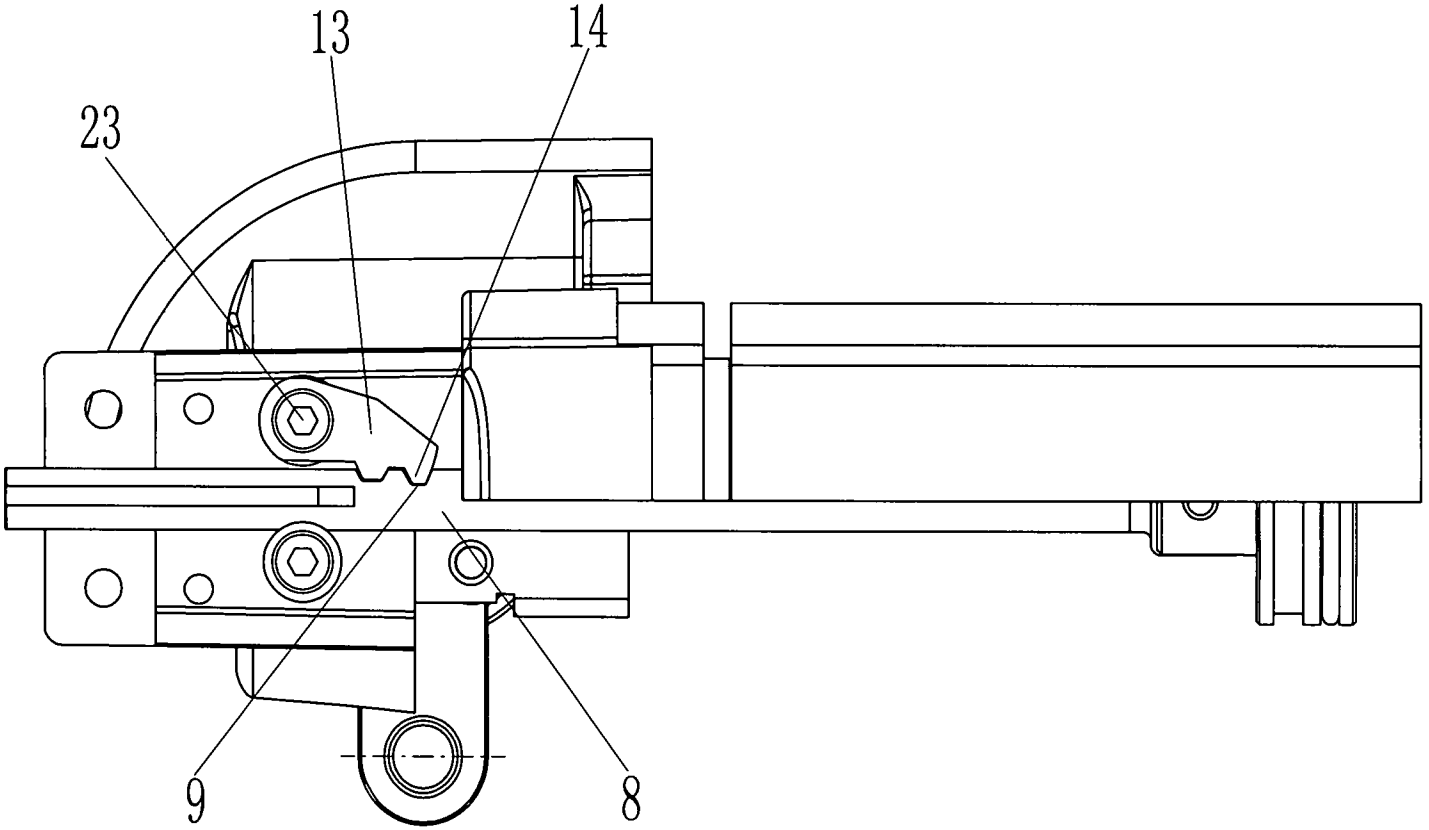
FIG. 4 is a top view of the spacer locking the striker of the present invention.
Figure 5:
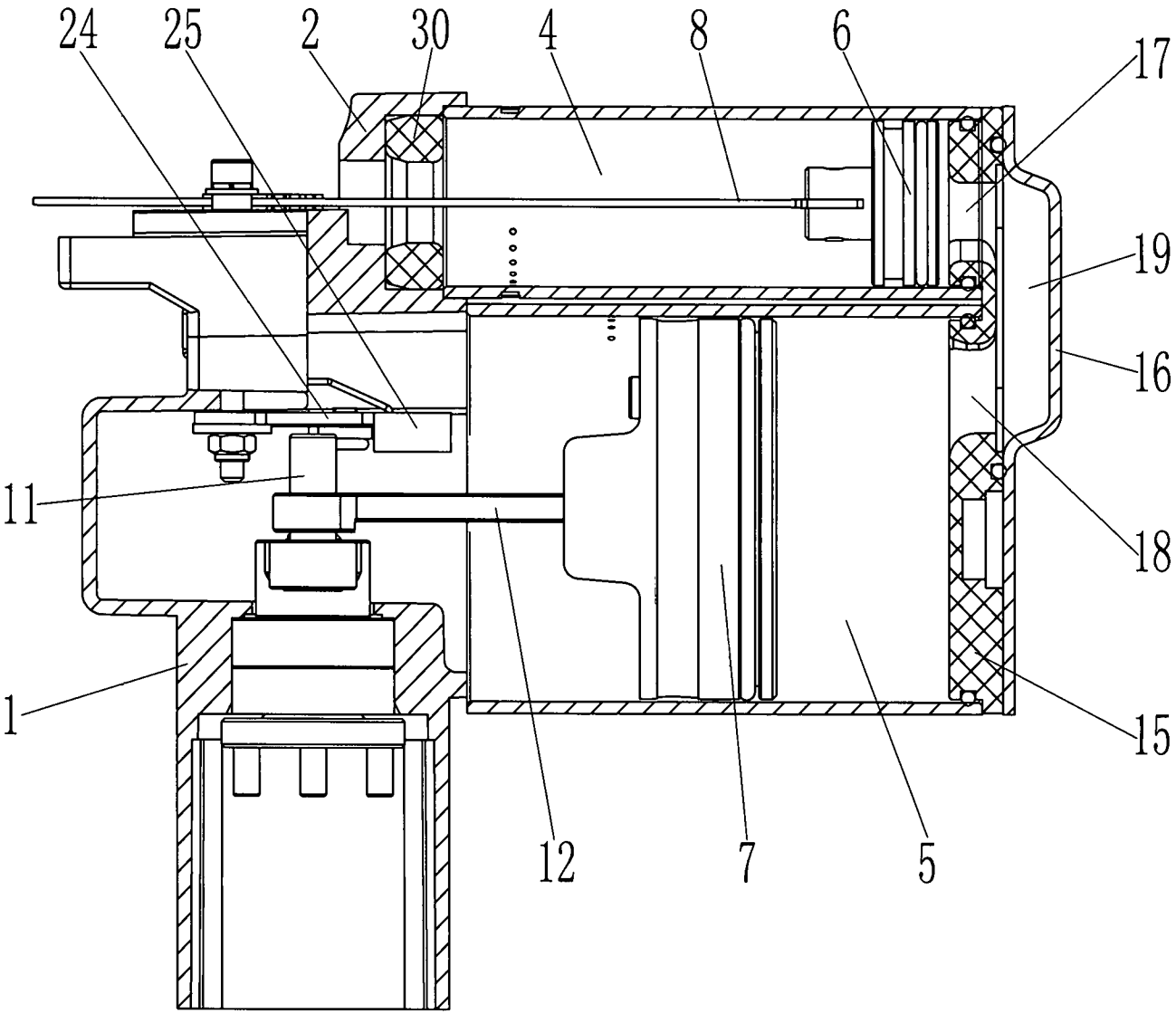
FIG. 5 is a sectional view of the spacer locking the striker of the present invention.
Figure 6:
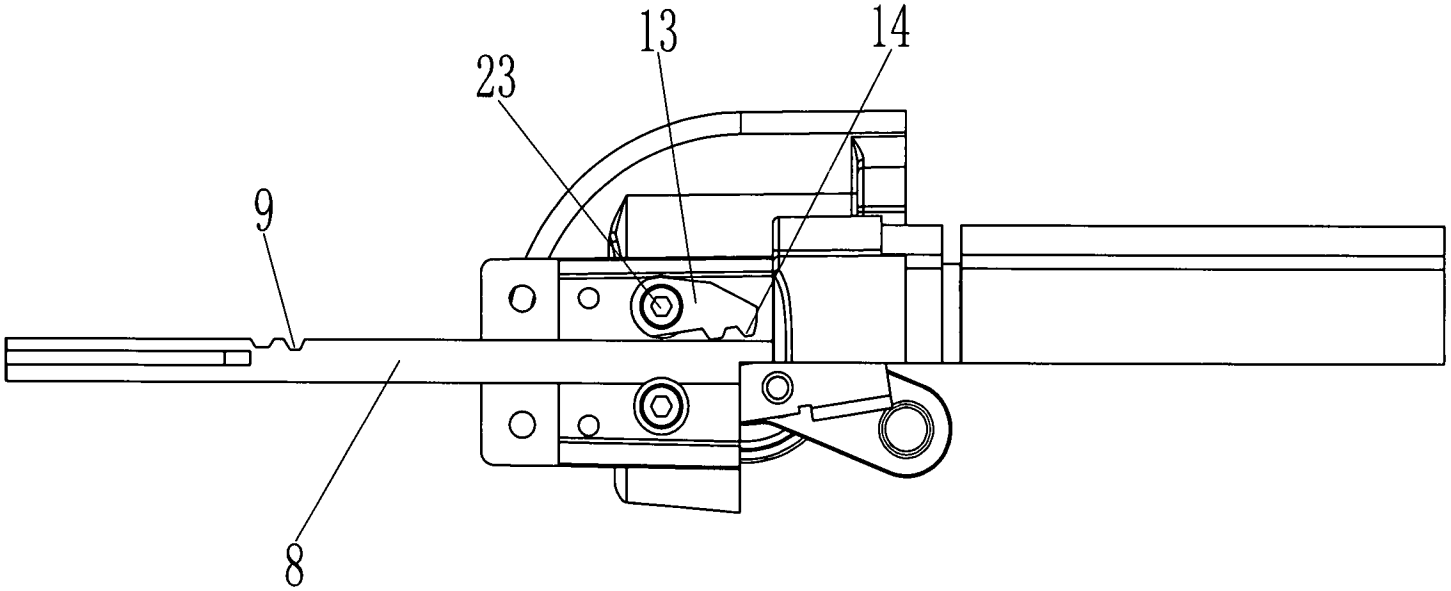
FIG. 6 is a top view of the spacer disengaged from the striker of the present invention.
Figure 7:
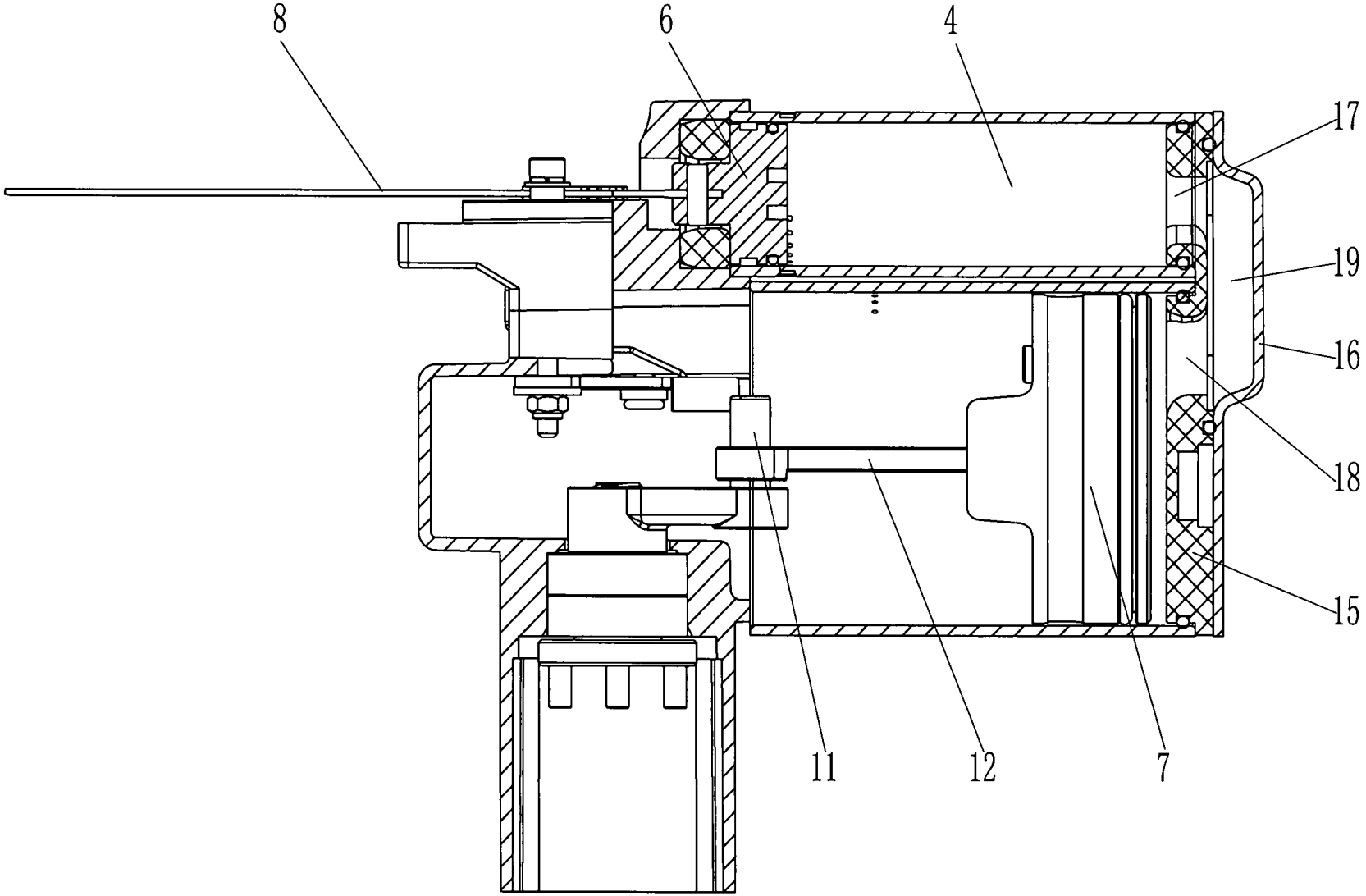
FIG. 7 is a sectional view of the spacer disengaged from the striker of the present invention.

FIG. 1 to FIG. 7 disclose the locking device on the striker of double-cylinder electric nail gun of the present invention, which comprises a gear box 1, a union joint 2 is located on the top right of the gear box 1, the left sidewall of union joint 2 is provided with a mobile hole 3 connected to the inner space thereof; the union joint 2 is connected to a first cylinder 4; the right sidewall of the gear box 1 is provided with a second cylinder 5 connected to the inner space thereof, the second cylinder 5 is located normally under the first cylinder 4; a matched first piston 6 is located in the first cylinder 4, a matched second piston 7 is located in the second cylinder 5; the first piston 6 is connected to a striker 8; the front of the striker 8 penetrates through the mobile hole 3 to the outside, the front of striker 8 exposed to the outside is provided with several notches 9; an eccentric shaft seat 10 is located in the gear box 1, an eccentric shaft 11 is located on one side of eccentric shaft seat 10; the second piston 7 is hinged on a piston arm 12, the left end of piston arm 12 penetrates through the second cylinder 5 and into the gear box 1; an eccentric shaft 11 connected to the left end of piston arm 12 is located in the gear box 1; a rocker component corresponding to the position of eccentric shaft 11 is located in the gear box 1; the upper end of the rocker component is extended out of the gear box 1 and connected to a spacer 13, the spacer 13 is provided with several latches 14 matching the notches 9; the right opening of the first cylinder 4 is connected to the right opening of the second cylinder 5 by a cylinder seat 15; the cylinder seat 15 is provided with a cylinder cover 16; the cylinder seat 15 is provided with a first vent hole 17 connected to the first cylinder 4 and a second vent hole 18 connected to the second cylinder 5; one sidewall of the cylinder cover 16 opposite to the cylinder seat 15 is provided with a ventilating chamber 19; the first vent hole 17 is connected to the second vent hole 18 by the ventilating chamber 19.

The upper surface of the gear box 1 is provided with a rotary hole 20 and a guide hole 21, the rotary hole 20 and guide hole 21 are connected to the inner space of gear box 1; the rocker component comprises a guide column 22 located in the guide hole 21 and a connecting tube 23 located in the rotary hole 20; the spacer 13 is connected to the upper end of connecting tube 23; a first rocker 24 is hinged on the lower end of the guide column 22; one side of the right part of the first rocker 24 opposite to the eccentric shaft 11 is provided with a push part 25; the first rocker 24 is hinged on a connecting arm 26, the other end of connecting arm 26 is hinged on a second rocker 27; the left end of the second rocker 27 is connected to the lower end of connecting tube 23; a torsion spring 28 is fitted over the lower part of the connecting tube 23 in the gear box 1; the right end of the second rocker 27 is provided with a fixing slot 29; one end of the torsion spring 28 is fixed into the gear box 1, and the other end is stuck in the fixing slot 29.

A matched buffer 30 is located in the union joint 2.

The usage of the present invention is described below:

A motor is installed in the gear box 1 to drive the eccentric shaft seat 10, so that the eccentric shaft 11 can rotate, when the eccentric shaft 11 rotates, the eccentric shaft 11 moves towards the push part 25 of the first rocker 24, meanwhile the rotation of eccentric shaft 11 drives the second piston 7 to shift right through the piston arm 12, so that the second piston 7 penetrates into the second cylinder 5 continuously. At this point, the air pressure in the second cylinder 5 increases continuously, and the air in the second cylinder 5 is pushed by the second piston 7 into the ventilating chamber 19 through the second vent hole 18, and then it enters the first cylinder 4 through the first vent hole 17, the air pressure at the first vent hole 17 increases continuously, as the latches 14 of spacer 13 are locked in the notches 9 of striker 8, when the striker position is confined, the position of the first piston 6 is confined, the first piston 6 will not move though there is air pressure.

As the eccentric shaft 11 rotates continuously, the eccentric shaft 11 will impact the push part 25 of the first rocker 24 eventually, as the position of guide column 22 is confined by the guide hole 21, the first rocker 24 rotates round the guide column 22 under the thrust of eccentric shaft 11. When the first rocker 24 rotates, the first rocker 24 drives the second rocker 27 to rotate through the connecting arm 26, and the second rocker 27 is connected to the connecting tube 23, the connecting tube 23 rotates accordingly. As the spacer 13 is fixed to the upper end of connecting tube 23, the spacer 13 rotates accordingly, the latches 14 on the spacer 13 are disengaged from the notches 9 of striker 8. When the eccentric shaft 11 contacts the push part 25 and pushes the first rocker 24, the second piston 7 has completely penetrated into the second cylinder 5, the air pressure at the first vent hole 17 has been very high. When the striker loses the limitation of spacer 13, the first piston 6 ejects the striker 8 instantaneously under the high pressure, so that the striker 8 strikes the nail out. The first piston 6 drives the striker 8 to return after one strike, and the connecting tube 23 is restored under the effect of torsion spring 28. As the connecting tube 23 is restored, the latches 14 of spacer 13 are stuck in the notches 9 of striker 8 again, the spacer 13 will be opened again when the required air pressure is reached, a cycle is formed.

To sum up, when the air pressure in the second cylinder 5 is compressed to a certain extent, the eccentric shaft 11 pushes the push part 25 of the first rocker 24, the spacer 13 is opened by the rocker component eventually. At this point, the high pressure in the second cylinder 5 is directly applied to the first piston 6 in the first cylinder 4 through the second vent hole 18, ventilating chamber 19 and the first vent hole 17 in turn. When the striker 8 is free from the limitation of spacer 13, the first piston 6 ejects the striker 8 instantaneously under high pressure, so that the striker 8 strikes the nail out. This nailing method can eject the striker 8 automatically when the air pressure in the first cylinder 4 increases to a certain extent, so as to implement automatic nailing, preventing the complex nailing process that the worker has to open the spacer after the air pressure reaches the required level, the nailing efficiency is increased to the maximum extent.

A matched buffer 30 is located in the union joint 2. When the first piston 6 moves towards the outside instantaneously under high pressure, the buffer 30 has a cushioning effect on the first piston 6, so as to avoid excessive impact force of the first piston 6 damaging the union joint 2 and the first piston 6.

We claim:

1. A locking device on the striker of double-cylinder electric nail gun, comprising a gear box, wherein a top right of the gear box is provided with a union joint, a side wall of the union joint is provided with an aperture connected to an inner space of the union joint; the union joint is connected to a first cylinder; a side wall of the gear box is provided with a second cylinder connected to the inner space of the gear box and located directly below the first cylinder; a matched first piston is located in the first cylinder, a matched second piston is located in the second cylinder; the first piston is connected to a striker; a front of the striker penetrates through the aperture to the outside, the front of the striker exposed to the outside is provided with several notches; an eccentric shaft seat is located in the gear box, one side of eccentric shaft seat is provided with the eccentric shaft; the second piston is hinged on a piston arm, the distal end of the piston arm is extended out of the second cylinder and into the gear box; the eccentric shaft connected to the distal end of the piston arm is located in the gear box; a rocker component corresponding to the eccentric shaft is located in the gear box; an upper end of the rocker component is extended out of the gear box and connected to a spacer, the spacer is provided with several latches matching the notches; a proximal opening of the first cylinder is connected to a proximal opening of the second cylinder by a cylinder seat; the cylinder seat is provided with a cylinder cover; the cylinder seat is provided with a first vent hole connected to the first cylinder and a second vent hole connected to the second cylinder; one sidewall of the cylinder cover opposite to the cylinder seat is provided with a ventilating chamber; the first vent hole is connected to the second vent hole through the ventilating chamber.

2. The locking device defined in claim 1, wherein an upper surface of the gear box is provided with a rotary hole and a guide hole, the rotary hole and guide hole are connected to the inner space of the gear box; the rocker component comprises a guide column located in the guide hole and a connecting tube located in the rotary hole; the spacer is connected to an upper end of the connecting tube; a first rocker is hinged on a lower end of the guide column; one side of the first rocker opposite to the eccentric shaft is provided with a push part; the first rocker is hinged on a connecting arm, a second rocker is hinged on the other end of the connecting arm; a left end of the second rocker is connected to a lower end of connecting tube; a torsion spring is fitted over a lower part of the connecting tube in the gear box; a proximal end of the second rocker is provided with a fixing slot; one end of the torsion spring is fixed into the gear box, the other end is stuck in the fixing slot.

3. The locking device defined in claim 1, wherein the union joint includes a matched buffer disposed therein.

* * * * *